United States Patent [19]

Miller

[11] Patent Number: 5,049,412

[45] Date of Patent: Sep. 17, 1991

[54] METHOD OF REALKALIZING CONCRETE IN WHICH CARBONATION HAS OCCURRED

[75] Inventor: John B. Miller, Olso, Norway

[73] Assignee: Norwegian Concrete Technologies AS, Oslo, Norway

[21] Appl. No.: 496,042

[22] Filed: Mar. 16, 1990

Related U.S. Application Data

[63] Continuation of Ser. No. 352,720, May 8, 1989, abandoned, which is a continuation of Ser. No. 75,771, Jul. 20, 1987, abandoned.

[51] Int. Cl.[5] ..... B32B 35/00

[52] U.S. Cl. ..... 427/140; 427/299; 427/136; 427/393.6

[58] Field of Search ..... 427/140, 299, 393.6, 427/136; 264/36

[56] References Cited

U.S. PATENT DOCUMENTS

| | | | |
|---|---|---|---|
| 3,145,502 | 8/1964 | Rubenstein | 427/393.6 |
| 3,499,783 | 3/1970 | Nelson et al. | 427/393.6 |
| 4,091,148 | 5/1978 | Blankenhurn et al. | 427/393.6 |
| 4,109,033 | 8/1978 | Blankenhorn et al. | 427/393.6 |
| 4,199,625 | 4/1980 | Pilny et al. | 427/393.6 |
| 4,342,796 | 8/1982 | Brown et al. | 427/136 |
| 4,363,836 | 12/1982 | Sakato et al. | 427/393.6 |
| 4,575,468 | 3/1986 | Sakuta | 427/393.6 |
| 4,596,725 | 6/1986 | Kluth et al. | 427/393.6 |

FOREIGN PATENT DOCUMENTS

| | | | |
|---|---|---|---|
| 463892 | 1/1974 | Australia | 427/393.6 |
| 58-194786 | 11/1983 | Japan | 427/393.6 |
| 61-221434 | 10/1986 | Japan | 427/393.6 |
| 914605 | 3/1982 | U.S.S.R. | 427/393.6 |

*Primary Examiner*—Shrive P. Beck
*Assistant Examiner*—Roy V. King
*Attorney, Agent, or Firm*—Schweitzer Cornman & Gross

[57] ABSTRACT

A method for realkalizing concrete, layers of which have become carbonated and thus acidified as result of exposure to air of the surface of the concrete. The method presupposes that the concrete still contains adjacent layers that have not yet become carbonated. A substantially water-tight adherent coating is applied to the surface of the concrete that is exposed to air. Thereafter, the concrete is caused to become saturated with water from a source external to the concrete structure, and this condition of saturation is maintained for a period of time sufficient to effect a diffusion of alkaline materials from the relatively less carbonated layers of the concrete into the relatively more carbonated layers thereof. The carbonated layers thus become realkalized, so that further deterioration of the concrete structure is significantly arrested.

6 Claims, 2 Drawing Sheets

METHOD OF REALKALIZING CONCRETE IN WHICH CARBONATION HAS OCCURRED

This application is a continuation of application Ser. No. 352,720, filed May 8, 1989, now abandoned, which is a continuation of application Ser. No. 075,771; filed July 20, 1987, now abandoned.

BACKGROUND OF THE INVENTION

The present invention concerns a method and a device for rehabilitating concrete layers where a formation of carbonate has occurred, especially in connection with reinforced concrete and brick wall constructions, such as buildings, pilings, docks and supporting brick walls.

In these and also in other types of concrete constructions reinforcement steel is used in order to increase the strength. The concrete protects the steel against corrosion through the highly alkaline environment that normally exists in the concrete. Absorption of acidic gases, mainly carbon dioxide, and in a less degree sulphur dioxide and sulphur trioxide from the atmosphere, leads to an acidifying of the concrete, and the alkalinity will be reduced. When the pH of the concrete is reduced to about 9.5 the imbedded steel is no longer protected, and corrosion starts. If at the same time chlorides are present, the corrosion starts at higher pH-values than 9.5.

This change in the concrete, that is called formation of carbonate, may lead to corrosion of the reinforcement steel which creates breaking or blasting of the outer layer of the concrete. This produces a certain risk of accident or damage, especially in connection with buildings. It will also weaken the concrete construction.

Such damage to concrete construction has reached the point of being a serious economical and technical problem. Traditional repair is based on sandblasting and/or removal of the concrete layer where formation of carbonate has occurred by cutting it away, cleaning and optionally applying an anticorrosion treatment to the steel, followed by the casting or applying of new concrete or mortar.

There exist materials, that when they are applied to concrete surfaces help to reduce the rate of formation of carbonate in that the concrete's diffusion resistance against gases is increased. However, such materials can not rehabilitate concrete where formation of carbonate has already occurred.

THE OBJECT OF THE INVENTION

The main object of the invention is to create a method and a device for rehabilitating concrete layers where formation of carbonate has occurred. A special object is to provide a method that can be accomplished without extensive work and without considerable disturbance of the activities that are going on in and near the concrete construction that is concerned.

THE PRINCIPLE OF THE INVENTION

According to the invention, rehabilitation of concrete layers, where formation of carbonate has already occurred, is achieved by applying to the surface of the concrete, where the carbonation has occurred, a gas-tight and water-tight film or coating. Thereafter, the concrete is caused or permitted to become saturated with water.

By continuing this method for a relatively short period, preferably from two to six weeks, a satisfying rehabilitation can be obtained.

The method gives the following effects:

1. The sealing layer cuts off the access of the atmosphere to the concrete surface and thus stops further absorption of acidic gases ($CO_2$).

2. The sealing layer also stops the water transport through the concrete. By enabling water to be supplied to the carbonated layer, from adjacent areas of the concrete, the concrete in the carbonated layer will in a short time become saturated with water.

3. When the concrete is saturated with water alkaline materials from the inner layers of the concrete, where formation of carbonate has not occurred, are allowed to diffuse through the rest of the concrete area. When this diffusion has, reached equilibrium the pH in the part where formation of carbonate earlier has occurred is raised to a level where reinforcement steel again is protected against corrosion. By this diffusion the concrete layers where formation of carbonate has occurred will be re-alkalized by transfer of alkaline materials from the inner layers of the concrete.

When the realkalization is accomplished (determined by sampling), the water supply can be stopped. The sealing layer on the concrete surface which is exposed to air however will be retained in order to avoid re-formation of carbonate due to carbon/dioxide or the like.

Other advantageous features of the invention will become apparent upon consideration of the following description of preferred forms of the invention.

DESCRIPTION OF THE DRAWINGS

The invention will in the following be described by reference to the drawings, where

In FIG. 1 is shown a horizontal plate formed of concrete construction 11, which is exposed to water pressure on the upper side and which is exposed to air on the underside. Due to the penetration of carbon/dioxide from the air an acidic layer 12, is created on the underside of the structure, where formation of carbonate has occurred. In the illustration of FIG. 1, the acidic layer is shown to include the reinforcement steel 13. Due to the material water pressure a transport of water will occur through the "unspoiled" (i.e. still alkaline) layer) 14 of the concrete 11 and through the 12 where formation of carbonate has occurred, from which the water is lost by evaporation or otherwise.

In FIG. 2 a gas and watertight film or coating 15 is applied to the side of the concrete construction 11 that is exposed to air. Due to the water pressure from behind the layer 14, the concrete will in short time become saturated with water without evaporation or in other ways losing water to the air.

FIG. 2 illustrates the situation that has occurred when the alkaline materials have been allowed to diffuse from the "unspoiled" concrete layer 14 and into the part 12 where formation of carbonate has occurred and thus have realkalized this part. This means that the reinforcement steel 13 no longer is exposed to corrosion, as it is surrounded by an alkaline environment.

This situation can take place in tunnels, rocks, cellars and in bridges, dikes and water towers, for example.

Figure 1:
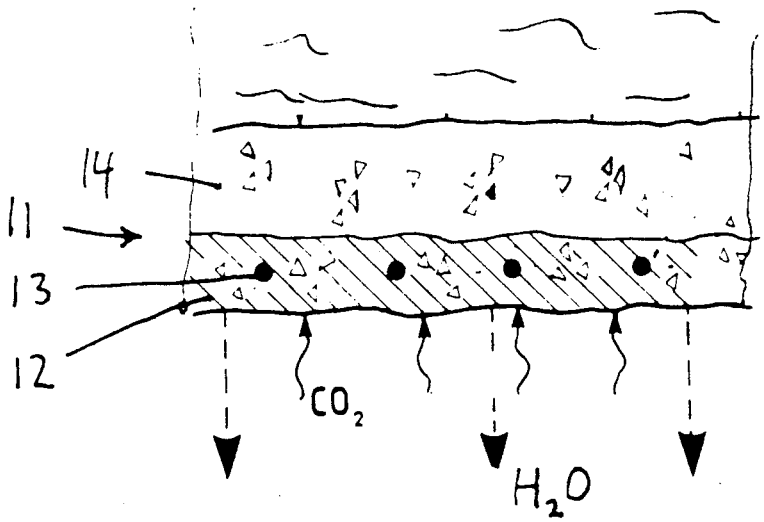
FIG. 1 is a schematic illustration of a section through a concrete construction having an outer layer where formation of carbonate has occurred.
Figure 2:
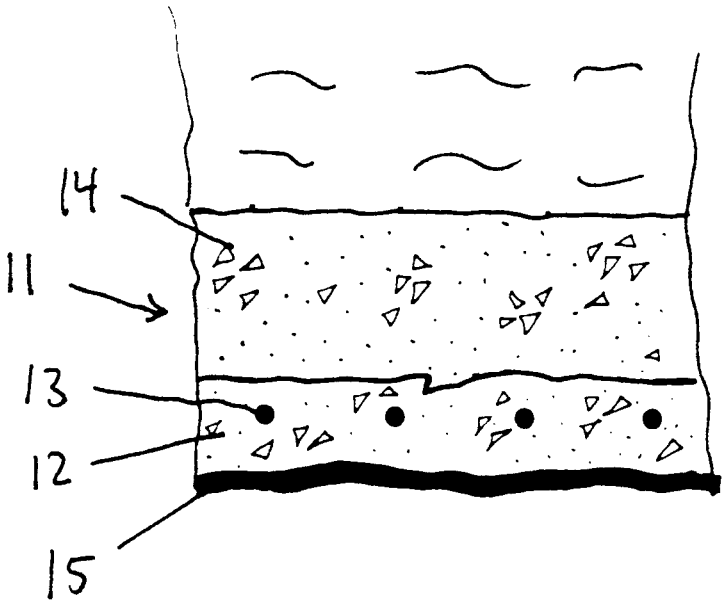
FIGS. 2, 3 and 4 schematically illustrate sections through different concrete constructions, where the method in accordance with the invention is accomplished in different ways.
Figure 3:
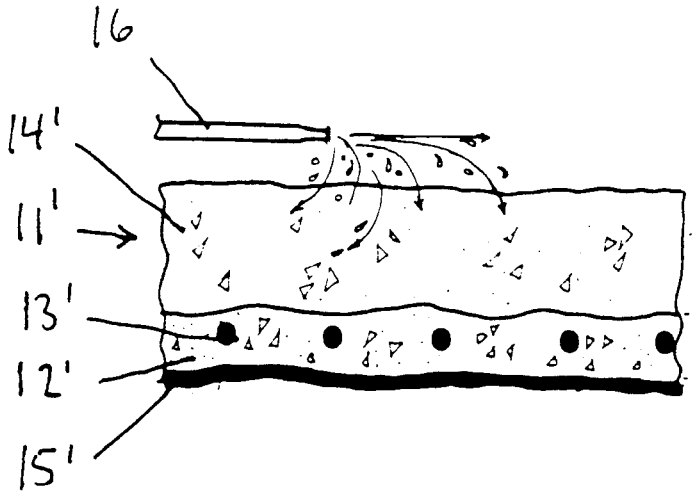

FIG. 3 illustrates an embodiment of the invention that is relevant for a concrete construction 11' that stands free, such as facades, pavings, chimneys, silos and so on. A tight film or coating 15' also in this case is applied to that side of the concrete where formation of carbonate has occurred. The concrete is humidified with water from a tube 16 on the upper side. The concrete must be supplied with water in such a way that the concrete humidity is higher than about 90% relative humidity, preferably higher than 95%. The part of the concrete where formation of carbonate has occurred is given reference number 12', the reinforcement bar is given reference number 13' and the alkaline concrete part is given the number 14'.

Figure 4:
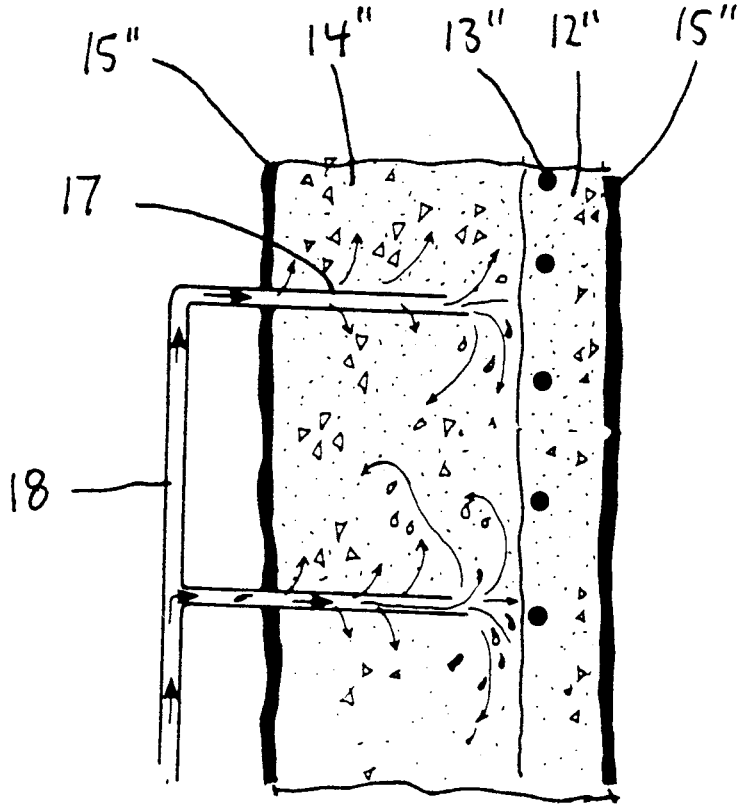

FIG. 4 illustrates an alternative to the embodiment in FIG. 3, where both sides of a vertical, plate-formed concrete construction are exposed to air and where formation of carbonate has occurred. A sealing film or coating 15'' is applied to both sides. For water supply one or more openings 17 (see FIG. 4) are provided in the concrete, and these are connected to a pipe system 18 for filtering in or injecting water. In this case a complete water saturation can be obtained in the concrete volume.

As a sealing layer or film, any material can be applied that can be bonded to the concrete surface in liquid condition, and that solidifies or hardens and becomes a gas and watertight coating with sufficient adhesion to the concrete.

Especially suitable materials are thermoset plastics with a low content of solvent, such as epoxies and polyurethanes. In some cases it is also possible to use bituminous mixtures and diffusion tight paints.

Alternatives:

The supply of water to the concrete construction can be carried out in other ways than those described above. For example a terminal surface of a concrete construction that is coated on both sides with sealing films or coatings can be supplied with water by holes optionally drilled down into the concrete.

As an alternative to the sealing films or coatings, plates can be used that are fastened to the concrete in a way such that loss of water content is avoided. This can be relevant in connection with architectural rehabilitation of facades. Tight fitting facade plates can be used and mounted side by side. The space between the concrete and the plate in each facade can optionally be filled with an adhering, filling and/or sealing substance, for example a mortar.

The water that is supplied may contain useful additive materials, for example materials that make the water alkaline, such as solutions of alkaline substances or lime, and materials that increase the penetrating ability of the water.

I claim:

1. The method of rehabilitating a concrete structure, wherein an outer layer of the concrete structure containing reinforcement has become carbonated through exposure to air over a period of time, and an adjacent layer of the concrete structure remains relatively less carbonated, which comprises the steps of:

(a) initially applying to the outer surface of said concrete structure a water-tight adherent coating, (b) thereafter saturating said outer and adjacent layers of said concrete structure behind said water-tight coating with water from a source of water external to said concrete structure, and (c) maintaining said concrete structure in its thus saturated condition for a period of time sufficient to effect diffusion of alkaline materials from the relatively less carbonated adjacent layer of said structure into the relatively carbonated outer layer thereof to effect realkalization said outer layer.

2. A method according to claim 1, further characterized by, (a) the side of said concrete structure opposite the surface having the adherent water-tight coating being exposed to water under pressure, and (b) the saturated condition of said concrete structure being brought about by continued exposure of the structure to said water under pressure after application of said water-tight coating.

3. A method according to claim 1, further characterized by, (a) delivering a supply of water to the adjacent layer of said concrete structure by the discharge of water onto the surface of said structure remote from said outer layer, and (b) so managing said delivering of water as to maintain said concrete structure at a humidity above 90% relative humidity.

4. A method according to claim 1, and wherein said structure has been exposed to air on its opposite outer surfaces and has become carbonated on said opposite outer surfaces, further characterized by, (a) initially providing said concrete structure on both outer surface with gas-tight and water-tight coatings, (b) providing one or more openings into the interior of said structure through one of said coatings, and (c) thereafter saturating said concrete structure by injecting water into said structure behind said coatings through said openings.

5. A method according to claim 1, further characterized by, (a) the water supplied to said structure being modified by the addition of solutions of alkaline substances.

6. A method according to claim 1, further characterized by, (a) said adherent coating being also substantially gas-tight.

* * * * *